United States Patent [19]

Wedeniwski

[11] Patent Number: 4,892,082

[45] Date of Patent: Jan. 9, 1990

[54] DRESSING ROLL AND METHOD FOR PRODUCING THE SAME

[75] Inventor: Horst J. Wedeniwski, Remshalden-Grunbach, Fed. Rep. of Germany

[73] Assignee: Fortuna-Werke Maschinenfabrik GmbH, Fed. Rep. of Germany

[21] Appl. No.: 288,016

[22] Filed: Dec. 20, 1988

[30] Foreign Application Priority Data

Dec. 23, 1987 [DE] Fed. Rep. of Germany ..... 3743813
Apr. 8, 1988 [DE] Fed. Rep. of Germany ..... 3811783

[51] Int. Cl.[4] ..... B24B 53/00
[52] U.S. Cl. ..... 125/11 R; 125/39; 51/206 R
[58] Field of Search ..... 125/11 R, 39; 51/206 R, 51/206.4, 206 P, 209 R

[56] References Cited

U.S. PATENT DOCUMENTS 2,380,451 7/1945 Koebel ..... 125/11 R

FOREIGN PATENT DOCUMENTS 1968017 5/1967 Fed. Rep. of Germany .
3016740 4/1980 Fed. Rep. of Germany .

OTHER PUBLICATIONS

"Handbuch der Fertigungstechnik" from G. Spur and Th. Stöferle, Carl Hanser Verlag, vol. 3/2, 1980, p. 144.

*Primary Examiner*—Frederick R. Schmidt
*Assistant Examiner*—Maurina Rachuba
*Attorney, Agent, or Firm*—Walter A. Hackler

[57] ABSTRACT

A dressing roll comprises a revolving circumferential surface, in particular two conical circumferential surfaces (12, 13) intersecting each other along an outer circumferential line (14). The circumferential surface is garnished with diamonds. In order to ensure that the diamond needles attack a grinding wheel to be dressed over a two-dimensional surface and to avoid the production of spiral-shaped dressing grooves in the grinding wheel surface, the diamonds take the form of diamond needles (15, 16) which project obliquely from the circumferential surface (12, 13) and whose free ends (17, 18) overlap each other in the circumferential direction (FIG. 1).

6 Claims, 2 Drawing Sheets

DRESSING ROLL AND METHOD FOR PRODUCING THE SAME

The present invention relates to a dressing roll comprising a revolving circumferential surface garnished with diamonds.

It has been known before to dress worn grinding wheels of grinding machines by working the worn surface of the grinding wheel by a diamon-garnished profile roll. The cutting edges of the diamonds projecting from the surface of such a dressing roll break up both any residues of the material of the workpieces that have been worked before by the grinding wheel, which may have deposited in the chip spaces between the grinding grains, and also the grains of the grinding wheel as well as the compound in which they are embedded, i.e. the so-called grain bond, so that upon completion of the dressing process of the grinding wheel the surface of the latter exhibits sharp grinding grains projecting from the surface of the grinding wheel, with defined chip spaces arranged between them.

Dressing rolls of the type described above have been described on page 144 of the textbook "Handbuch der Fertigungstechnik" by G. Spur and Th. Stofferle, published by Carl Hanser Verlag, 1980, Vol. 3/2.

Known dressing rolls are produced, for example, by applying to the surface of a cylindrical or double-conical dressing roll a paste which is capable of being chemically reduced so that finally a metallic coating remains on the surface of the dressing roll. Prior to the reducing process, the diamonds are pressed into the paste by hand, according to a predetermined distribution pattern, at a rate of, for example, 40 diamonds per $cm^2$.

When the diamonds are arranged along a circumferential line of the dressing roll, it may happen in the case of the known dressing rolls that the dressing process is carried out only along a line of the grinding wheel if—as is usual in such cases—the dressing roll and the grinding wheel are arranged coaxially, rotate in opposite senses, and the dressing roll is guided approximately along a generating line of the grinding wheel. As the dressing roll advances in the direction of the generating line, it then produces a spiral-shaped dressing groove on the surface of the grinding wheel, and the grinding wheel is dressed only in the area of this groove.

Now, it is the object of the present invention to improve a dressing roll of the type described above in such a manner that the grinding wheel is dressed over the full surface and that spiral-shaped dressing grooves are avoided.

This object is achieved according to the invention by an arrangement which is characterized in that the diamonds take the form of diamond needles which project obliquely from the circumferential surface and whose free ends overlap each other in the circumferential direction.

This solves the object underlying the invention fully and completely because when the overlapping amount of the free ends of the diamond needles is selected appropriately, the said free ends will cover a strip which, provided the feed motion in the direction of the generating line of the grinding wheel is selected conveniently, has the effect that the whole surface of the grinding wheel will be covered and, accordingly, dressed completely.

It is an additional advantage of this arrangement that during the dressing process, the different surface areas of the grinding wheels are pre-dressed by the free end of the leading diamond needle, and after-dressed by the trailing free end of the next diamond needle so that the dressing roll attacks the grinding wheel surface twice at short intervals and at slightly displaced points, whereby the grinding wheel surface is broken up particularly efficiently.

According to a preferred embodiment of the invention, the diamond needles are arranged on two conical circumferential surfaces intersecting each other along one outer circumferential line, and the free ends of the diamond needles projecting from one circumferential surface overlap the other circumferential surface.

These features are particularly advantageous because the problem of the spiral-shaped dressing groove described before will be encountered of course in particular when the dressing roll itself engages the grinding wheel by only a single point of its surface, which will be the case when the conical circumferential surfaces meet along a pointed line. The described overlapping arrangement of the diamond needles, where each of the latter overlaps part of the other circumferential surface, now also leads to a strip-like active surface of the dressing roll so that full-surface dressing is achieved also with this conventional, pointed design of the dressing roll.

The present invention further relates to a method for producing a dressing roll of the type described above.

According to the invention, this method comprises the steps of working pocket-shaped recesses into the circumferential surface, positioning the lower ends of the diamond needles in these recesses, and fixing them therein by means of an embedding compound.

This feature provides the advantage that it is possible, by the particular design of the pocket-shaped recesses, to predetermine a suitable angle of inclination for the diamond needles so that when the latter are given a suitable length, the desired overlapping is automatically obtained. By embedding the diamond needles in the recesses, using an embedding compound, the diamond needles are positively held in the recesses in form-locking engagement, which increases the sturdiness of the dressing roll.

According to a preferred variant of this embodiment of the invention, the recesses are given the shape of an annular groove extending all around the roll.

This feature provides the advantage that during production of the dressing roll this annular groove can be produced by simpler means than would be the case if individual recesses were to be produced.

According to a preferred embodiment of the method according to the invention, the recesses are produced by the electrical discharge wire-erosion process.

This feature provides the advantage that when fine wires are used for the electrical discharge machining process, recesses of defined shape and distribution can be produced in the circumferential surfaces, and their position and orientation can in addition be adapted to the diamond needles available.

According to another preferred embodiment of the method according to the invention, the embedding compound is a sintered material.

This feature provides the advantage that the diamond needles can be fixed in the pocket-shaped recesses by a process that can be controlled in a technologically simple manner.

Other advantages of the invention will appear from the specification and the attached drawing.

It is understood that the features that have been described before and will be explained hereafter may be used not only in the described combinations, but also in any other combination, or individually, without leaving the scope and intent of the present invention.

One embodiment of the invention will now be described in more detail with reference to the drawing in which.

Figure 3:
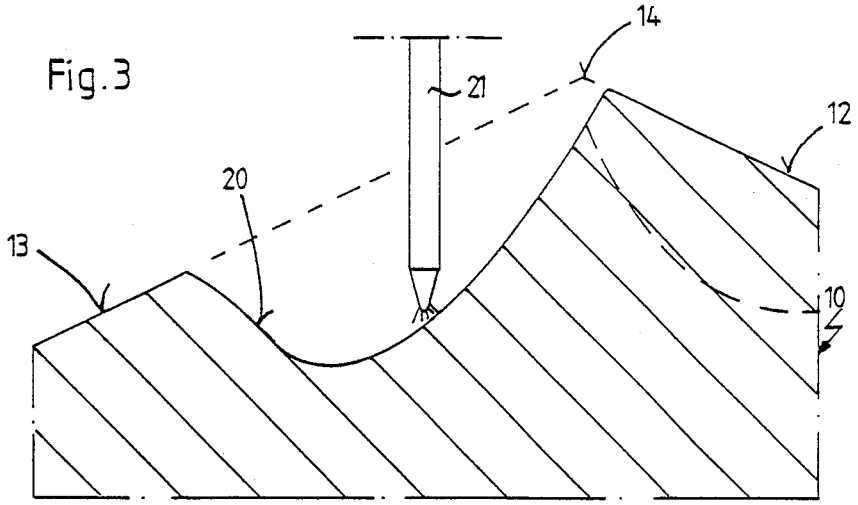
FIG. 3 shows a cross-section through a detail, in still further enlarged scale, illustrating one embodiment of the method according to the invention.
Figure 4:
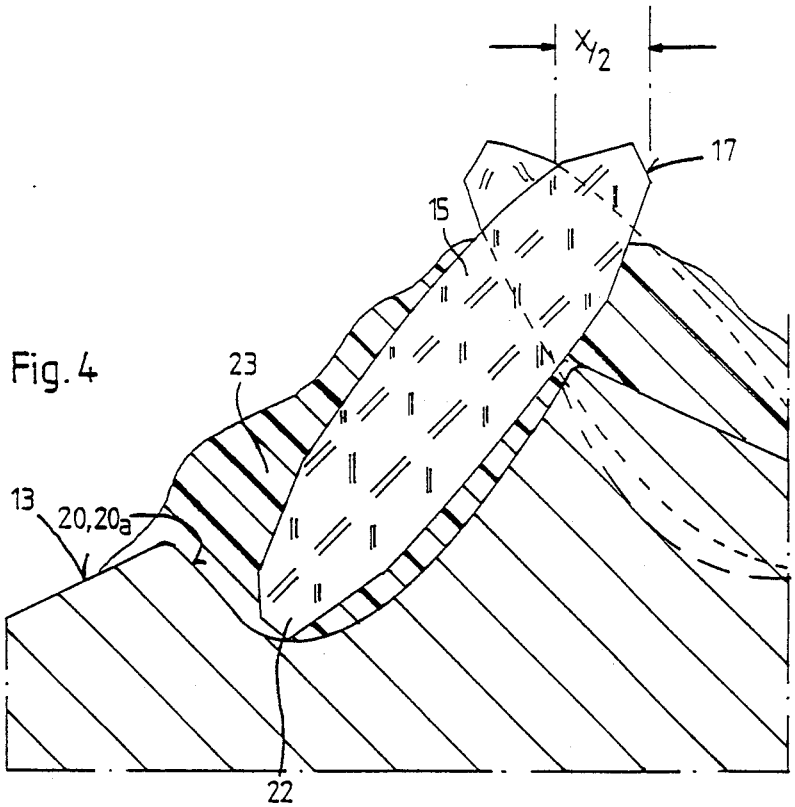

FIG. 4 a representation similar to that of FIG. 3, but for another process step.

Figure 1:
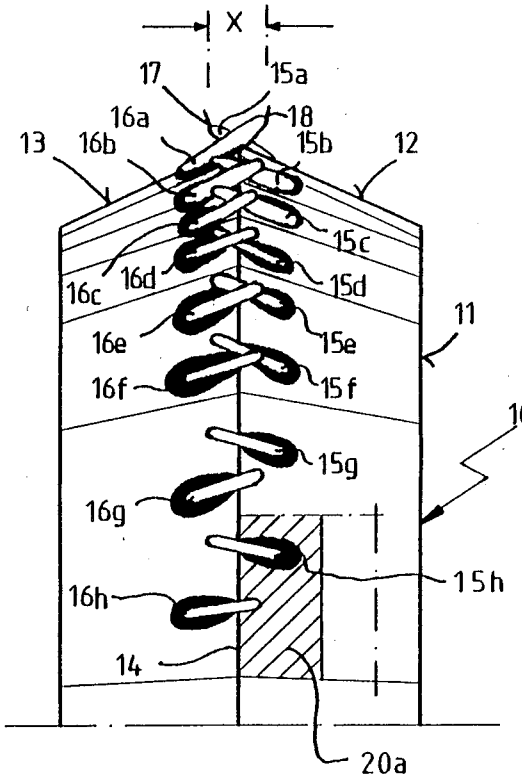
FIG. 1 shows a side view, partly broken away, of a circumferential portion of a dressing roll according to the invention, in greatly enlarged scale.

In FIG. 1, a dressing roll of the type used for reconditioning worn dressing rolls is indicated generally by reference numeral 10.

The dressing roll 10 exhibits an axially symmetrical shape and comprises two radial end faces 11. Its circumference exhibits two conical circumferential surfaces 12, 13 intersecting each other at about the longitudinal center plane of the dressing roll 10, along one outer circumferential line 14.

The right-hand conical circumferential surface 12 of the dressing roll 10—as viewed in FIG. 1—is garnished with diamond needles 15*a*, 15*b*, 15*c* . . . Similar diamond needles 16*a*, 16*b*, 16*c*. . . are provided on the second conical circumferential surface 13, in mirror-symmetrical arrangement.

The arrangement of the diamond needles 15 . . . and 16 . . . is selected in such a manner that the needles project obliquely from the circumferential surfaces 12, 13, with their free ends 17, 18 overlapping the other circumferential surface 13, 14, respectively. The arrangement thus obtained resembles that of a zip fastener, with the free ends 17, 18 overlapping each other by an amount x.

If one assumes a usual circumferential speed of the grinding wheel of 45 m/x and a diameter of the grinding wheel of 600 m/s, then the pitch of the spiral-shaped dressing groove will be in the order of 0.3 mm for a rate of feed of the dressing roll of, for example, 400 mm/min. and a theoretical point-shaped contact area between the dressing roll and the grinding wheel.

This pitch has to be considered when determining the overlapping amount x if it is to be ensured, for a given grinding wheel geometry and a given circumferential speed or rotary speed of the grinding wheel, and for a given rate of feed of the dressing roll in the axial direction, that a strip-like active area is obtained for the overlapping free ends 17, 18 of the grinding wheel which strip will not leave any undressed surface areas.

FIGS. 3 and 4 illustrate two phases of the process for producing a dressing roll 10 according to the invention.

The process starts out from a blank of a dressing roll 10 consisting, for example, of a metallic material and provided on its circumference with the conical surfaces 12, 13 intersecting each other along the circumferential line 14.

Now, pocket-shaped recesses 20 are worked into the circumferential surface 12, 13 in the neighborhood of the circumferential line 14, using suitable tools, preferably an EDM wire 21. The pocket-shaped recesses 20 extend substantially in the axial direction, but may also be slightly inclined towards the axial direction.

In FIGS. 1 to 4, reference numeral 20*a* indicates that instead of working individual recesses 20, it is also possible to provide a continuous annular groove in which the diamond needles can be embedded, distributed over the circumference.

As is illustrated by FIG. 4, the geometry of the pocket-shaped recesses 20 is adjusted in such a manner that the lower ends 22 of the diamond needles 15 are positioned in the recess 20 where they can be covered up by an embedding compound 23 so that quite a considerable length of the needles is held positively in the recesses, embedded in the embedding compound 23.

Figure 2:
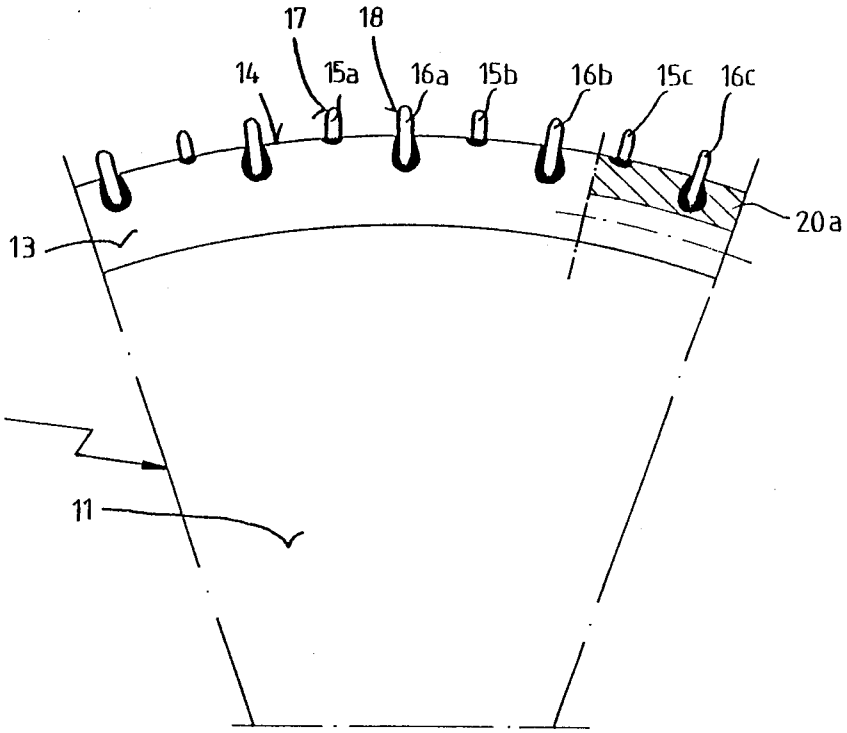
FIG. 2 shows a front view of the arrangement illustrated in FIG. 1.

If a continuous annular groove 20*a* is used instead of pocket-shaped recesses 20, the whole annular groove 20*a* is filled with the embedding compound 23, as indicated by the shaped areas in FIGS. 1 and 2. As can be clearly seen in FIG. 4, the embedding compound 23 may also reach beyond the edge of the groove 20*a* and/or the recesses 20 and cover up part of the circumferential surfaces 12/13. The embedding compound 23 may even reach close to the point of the diamond needles 15, if only a sufficiently long point projects clear of the embedding compound 23.

The embedding compound 23 may consist either of a reducible metal paste, in which case the diamond needles are retained in the recesses 20 by the metallic embedding compound 23 after the reduction process, or else of a sintered material in which case the diamond needles are sintered into the recesses 20 by a suitable heat treatment.

I claim:

1. A dressing roll for dressing grinding wheels comprising a rotational roll body having a circumferential surface and an axis of rotation, said roll body defining a radial plane, extending perpendicularly to said axis, said dressing roll further comprising a plurality of diamond crystals being shaped as needles with a longitudinal axis, said needles being embedded into said surface over part of said longitudinal axis such that free ends of said needles protrude from said surface, said needles being, further, inclined with respect to said radial plane with a first number of needles being inclined in one direction and a second number of needles being inclined in a second direction opposite to said first direction, said first and second number of needles being arraned on said circumferential surface such that said free ends of said first number of needles overlap said free ends of said second number of needles when viewed in a circumferential direction.

2. The dressing roll of claim 1 wherein said needles are arranged on a first and a second conical circumferential surface of said roll body, said surfaces intersecting each other along an outer circumferential line, said first number of needles being arranged on said first conical surface and said second number of needles being arranged on said second conical surface, said free ends overlapping each other over said circumferential line.

3. A method for manufacturing a dressing roll according to claim 1 comprising the steps of working pocket-shaped recesses into said circumferential surface, positioning lower ends of said needles in said recesses and fixing said lower ends in said recesses by means of an embedding compound.

4. The method of claim 3 wherein said recesses are worked into said circumferential surface as an annular groove extending all around said roll body.

5. The method of claim 3 wherein said recesses are worked into said circumferential surface by means of an electrical discharge wire-erosion process.

6. The method of claim 3 wherein a sintered material is used as said embedding compound.

* * * * *